US009680213B2

(12) United States Patent
Pan et al.

(10) Patent No.: US 9,680,213 B2
(45) Date of Patent: Jun. 13, 2017

(54) ANTENNA ELEMENT FOR WIRELESS COMMUNICATION

(71) Applicants: Tyco Electronics AMP GmbH, Bensheim (DE); TE Connectivity Nederland BV, s'Hertogenbosch (NL)

(72) Inventors: Sheng-Gen Pan, Kamp-Lintfort (DE); Andreas Engel, Fraenkisch-Crumbach (DE); Wijnand Van Gils, Raamsdonksveer (NL)

(73) Assignees: TE Connectivity Nederland BV, 'S-Hertogenbosch (NL); TE Connectivity Germany GmbH, Bensheim (DE)

( * ) Notice: Subject to any disclaimer, the term of this patent is extended or adjusted under 35 U.S.C. 154(b) by 184 days.

(21) Appl. No.: 14/332,295

(22) Filed: Jul. 15, 2014

(65) Prior Publication Data

US 2015/0022417 A1 Jan. 22, 2015

(30) Foreign Application Priority Data

Jul. 16, 2013 (EP) ..... 13176706

(51) Int. Cl.
*H01Q 1/48* (2006.01)
*H01Q 9/04* (2006.01)
(Continued)

(52) U.S. Cl.
CPC ..... *H01Q 1/48* (2013.01); *H01Q 9/045* (2013.01); *H01Q 9/40* (2013.01); *H01Q 1/3275* (2013.01)

(58) Field of Classification Search
CPC ..... H01Q 9/0442; H01Q 1/48; H01Q 9/16; H01Q 1/38; H01Q 1/243
See application file for complete search history.

(56) References Cited

U.S. PATENT DOCUMENTS 6,337,666 B1 1/2002 Bishop
6,559,809 B1 * 5/2003 Mohammadian ..... H01Q 1/243 343/702

(Continued)

FOREIGN PATENT DOCUMENTS

EP 2827448 1/2015

OTHER PUBLICATIONS

"Bending and crumpling effects on a wearable planar monopole antenna", Antenna Technology and Applied Electromagnetics (ANTEM), 15th International Symposium, Aug. 9, 2012; 1 page.

(Continued)

*Primary Examiner* — Graham Smith
*Assistant Examiner* — Noel Maldonado
(74) *Attorney, Agent, or Firm* — Faegre Baker Daniels LLP

(57) ABSTRACT

The invention relates to an improved antenna element. Such an antenna element comprises a substrate, a first conductor and a second conductor. The substrate has at least a first lateral surface. The first conductor is provided on the first lateral surface, and includes a feed line portion and a monopole portion. The second conductor is provided at least partially on the same, first lateral surface, and includes: two ground planes which are disposed on the first lateral surface adjacent to the feed line portion of the first conductor at opposite sides thereof, and two stubs which are disposed on the first lateral surface at opposite sides of the respective of the two ground planes, and which extend in a direction parallel to the feed line portion of the first conductor. The two ground planes and the two stubs of the second conductor are arranged to form a coplanar waveguide.

14 Claims, 3 Drawing Sheets

(51) Int. Cl.
*H01Q 9/40* (2006.01)
*H01Q 1/32* (2006.01)

(56) References Cited

U.S. PATENT DOCUMENTS

| | | | | |
|---|---|---|---|---|
| 2008/0068276 | A1 | 3/2008 | Noro | |
| 2010/0328163 | A1 | 12/2010 | Abramov | |
| 2011/0187603 | A1* | 8/2011 | Komaki | H01Q 1/38 343/700 MS |

OTHER PUBLICATIONS

"Planar Monopole Antenna with Attached Sleeves", IEEE Antennas and Wireless Propagation Letters, vol. 5, 2006, 4 pages.
"Novel Design of Ultra-Wideband Printed Double-Sleeve Monopole Antenna", Progress in Electromagnetics Research Letters, vol. 9, 165-173, 2009; 9 pages.
European Search Report and Written Opinion issued by the European Patent Office, dated Dec. 17, 2013 for European Patent Application No. 13176706; 5 pages.

* cited by examiner

ANTENNA ELEMENT FOR WIRELESS COMMUNICATION

This application claims priority from European Patent Application EP13176706.3 filed Jul. 16, 2013, the subject matter of which is incorporated herein by reference.

BACKGROUND

The invention relates to an antenna element with coplanar waveguide for wireless communications.

In the field of car-to-car communication, specific antenna elements are provided for wireless communication between cars equipped with enabled on-board units. On-board units may be configured to detect information regarding current traffic situations (e.g. traffic jam, icy road, construction works) as well as car specific parameters (e.g. velocity, moving direction, acceleration, outside temperature, windscreen-wipers on).

This information can subsequently be transmitted via an air interface to other cars located in the same geographical region and equipped with accordingly enabled on-board units. A receiver of an on-board unit may thereafter analyze the information from various cars in order to improve the traffic safety as well as the efficiency for each car individually. Accordingly, the design of antenna elements has to meet technical challenges that are particularly present in the field of car-to-car communication.

One technical challenge in the field of car-to-car communication relates the directional radiation pattern of the antenna element. Specifically, it is advantageous for the antenna element to provide for an omni-directional radiation pattern in the horizontal plane.

The requirement for an omni-directional radiation pattern in the horizontal plane is inherent to the utilization of the antenna element for car-to-car communication. In combination with a car, the antenna element is to be used for wireless communication with other cars that can be positioned at any direction with respect to the car. Accordingly, it would be disadvantageous if the antenna element would realize a directional and not the required omni-directional radiation pattern in the horizontal plane.

In the context of this description, the term omni-directional radiation pattern of an antenna element is to be understood as its capability to radiate equal power in all directions perpendicular to the extent of the antenna element, i.e. in the horizontal plane.

Another technical challenge in the field of car-to-car communication relates to the dimensions and the shape of the antenna element for it to be incorporated in existent roof-top antenna assemblies.

The requirement for suitable dimensions and shape of the antenna element becomes immediately apparent from the necessity to incorporate the antenna element in an existing roof-top antenna assembly. Roof-top antenna assemblies have developed in recent years allowing various antenna elements to have a mounting position on the roof-top on the car. At the same time the roof-top antenna assembly provides a protective cover against environmental influences, for instance, moist climate and wind. Accordingly, it is advantages for antenna elements to be incorporated into the roof-top antenna assembly.

In recent years, roof-top antenna assemblies have been subject to frequent re-designs in order to incorporate antenna elements, for instance, for analog and digital radio reception, for GPS reception, for GSM/3G/4G communications, for WIFI communications and for television reception. Now, for an antenna element for car-to-car communication to be incorporated into an existent roof-top antenna assembly, it is a requirement for it to have dimensions and a shape to still geometrically fit into the roof-top antenna assembly, namely to fit in addition to various other antenna elements.

In the context of this description, the term car-to-car communication is to be understood as wireless communication in the frequency region of 5.8-6 GHz in Europe and North America. For example, the wavelength $\lambda$ of a radio wave at the desired frequency of 6 GHz corresponds to: $1 \cdot \lambda = 50$ mm.

Various designs of antenna elements have been discussed in the past, which are however disadvantages in view of the technical challenges present in the field of car-to-car communication named above. In the following, recent developments for antenna elements are briefly summarized.

U.S. Pat. No. 6,337,666 B1 relates to an antenna element that is printed on opposite sides of a dielectric substrate. An elongated first dipole half element is provided on one side of the dielectric substrate. A second dipole half element is provided on the opposite side of the dielectric substrate. Although the antenna generates an omni-directional pattern at horizon, the construction requires printing on two sides of the dielectric substrate. Specifically, for the second dipole half element to have an effect on the first dipole half element, the dielectric substrate needs to be thin (for example 0.005" to 0.125").

U.S. Pat. No. 6,559,809 B1 relates to a two-sided planar antenna configuration. On one side of a printed circuit board, there is provided a conductor including a microstrip feed line portion and a radiating poise portion. The other side includes a ground plane coupled with a structure functioning as a planar waveguide. As already mentioned above, the manufacturing of conductors on two sides of a printed circuit board is complex. Further, the two sides need to be co-located at close proximity, namely a distance of substantially less than one wavelength.

A disadvantageous embodiment is also described where the printed circuit board antenna is provided on a single side with a centre conductor for RF signal transmission and an outer conductor for a corresponding grounding potential. However, this design is described as being less flexible in increasing the impedance seen by the common mode current in the path to the feed line ground plane.

U.S. Pat. No. 7,965,242 B2 (filed as US 2010/0328163 A1) relates to a dual band antenna including a dual-band strip line monopole element. The monopole element includes a radio frequency choke, such as a planar waveguide strip located at one end of the element above a lower portion of the element. The overall length of the monopole element is selected so as to resonate at a first desired frequency. The length of the lower portion is selected so as to resonate at a second desired frequency. The antenna also includes a first reflector element for the first desired frequency and a second reflector element for the second desired frequency.

The dual band antenna is described as advantageous with respect to two spaced-apart frequencies, e.g. 2.4 GHz and 5 GHz. However, the design is disadvantageous with respect to single frequency band for car-to-car communication. Further, the first and second reflector elements prevent the antenna from having an omni-directional radiation pattern.

Zachou, V. et. al.: "Planar Monopole Antenna with Attached Sleeves"; IEEE Antennas and Wireless Propagation Letters, Vol. 5, p. 286-289, 2006 relates to an antenna element that consists of a printed monopole with one or two sleeves connected on each side thereto and fed by a coplanar waveguide line. Switches are used to control the length of the monopole and the sleeves and to tune the resonant frequencies of the antenna. In this design, a first resonance frequency is determined by the length of the monopole whereas a second resonance frequency is determined by the length of the sleeves and their activation.

The single- or dual-sleeved antenna configuration requires conductors, i.e. the sleeves, to be provided on each side of the monopole facing in the direction of the monopole's free end. Accordingly, the design is disadvantages with respect to the dimension and shape.

Dong, T. and Chen Y.-P.: "Novel Design of Ultra-Wideband printed double-sleeve Monopole Antenna"; Progress In Electromagnetics Research Letters, Vol. 9, p. 165-173, 2009 relates to a printed sleeve monopole antenna element. The antenna element is fed by a coplanar waveguide. Double sleeves with different sizes have been added to the ground plane. Thereby, the antenna element has ultra-wideband impedance characteristics.

The printed sleeve monopole antenna element requires conductors, i.e. the sleeves, to be provided on each side of the monopole facing in the direction of the monopole's free end. Accordingly, the design is disadvantageous with respect to the dimension and shape.

SUMMARY

In this respect, it is an object of the invention to suggest an improved busbar connection system which overcomes the disadvantage noted above, i.e. an antenna element which has an omni-directional radiation pattern, and is also advantageous with respect to the dimension and shape for it to be incorporated in existent rooftop antenna assemblies.

The object of the invention is attained by the subject-matter of the independent claim. Advantageous embodiments are subject to the dependent claims.

According to a first aspect of the invention, an antenna element is proposed with a configuration which allows for wireless communications, for example in the field of car-to-car communication. The structure of the antenna element is particularly adapted to enable its incorporation in existent roof-top antenna assemblies. Specifically, the suggested antenna element has a narrow proximal end where the areas surrounding a monopole portion of the antenna element are left empty. Thereby, the substrate of the antenna element can be formed to fit the dimensions and shape of existent roof-top antenna assemblies, namely to fit a narrow portion at its proximal end. Further, the monopole portion of the antenna element provides for an omni-directional radiation pattern advantageous in the field of car-to-car communication.

According to an embodiment in line with the first aspect of the invention, an antenna element is suggested comprising a substrate, a first conductor and a second conductor. The substrate has at least a first lateral surface. The first conductor is provided on the first lateral surface, and includes a feed line portion and a monopole portion. The second conductor is provided at least partially on the same, first lateral surface, and includes: two ground planes, which are disposed on the first lateral surface adjacent to the feed line portion of the first conductor at opposite sides thereof, and two stubs which are disposed on the first lateral surface at opposite sides of the respective of the two ground planes, and which extend in a direction parallel to the feed line portion of the first conductor. The two ground planes and the two stubs of the second conductor are arranged to form a coplanar waveguide.

According to a more detailed embodiment of the antenna element, the first lateral surface is laterally curved, the curvature having a radius in the range of $\lambda/4$ to $\lambda$, where $\lambda$ corresponds to the wavelength of the preferred frequency of the antenna element.

According to another more detailed embodiment of the antenna element, the substrate is shaped as a frustum of a cone with the first and second conductor disposed on at least one lateral surface thereof.

According to a further, more detailed embodiment of the antenna element, the first lateral surface is tilted with respect to a base of the substrate at an angle $\alpha$ in the range of 5 to 30 degrees.

According to yet another, more detailed embodiment of the antenna element, the monopole portion of the first conductor is provided on a portion of the substrate protruding from a top of the substrate.

According to an even further, more detailed embodiment of the antenna element, the two stubs are respectively coupled to the two ground planes at a predetermined distance from the free end of the first conductor, the predetermined distance corresponding to the length of the monopole portion of the first conductor.

According to another, more detailed embodiment of the antenna element, wherein the two stubs are electrically connected to the two ground planes via two link portions, respectively, and a length L3 of the two link portions determines the lateral spacing between the two stubs and the two ground planes, respectively.

According to a further, more detailed embodiment of the antenna element, the monopole portion of the first conductor is tilted with respect to the feed line (121) portion of the first conductor at an angle in the range of 5 to 30 degrees.

According to yet another, more detailed embodiment of the antenna element, the length of the monopole portion is $\lambda/4$ and the length of the two stubs is $\lambda/4$, where $\lambda$ corresponds to the wavelength of the preferred frequency of the antenna element.

According to an even further, more detailed embodiment of the antenna element, the substrate further includes a second lateral surface opposing the first lateral surface, and the second conductor further includes a third stub which is disposed on the second lateral surface at a position opposite to the feed line portion on the first lateral surface.

According to another, more detailed embodiment of the antenna element, the two stubs on the first lateral surface and the third stub on the second lateral surface together surround the feed line portion of the first conductor with respect to a cross section that is perpendicular to a direction in which the feed line portion extends.

According to further, more detailed embodiment of, the antenna element, wherein the second lateral surface is tilted with respect to a base of the substrate at an angle in the range of 5 to 30 degrees.

According to yet another, more detailed embodiment of the antenna element, the length of the third stub is $\lambda/4$, where $\lambda$ corresponds to the wavelength of the preferred frequency of the antenna element.

According to an even further, more detailed embodiment of the antenna element, wherein the third stub is coupled to the two ground planes at a predetermined distance from the free end of the first conductor, the predetermined distance corresponding to the length of the monopole portion of the first conductor.

According to another, more detailed embodiment of the antenna element, wherein the third stub is electrically connected to the two ground planes via a third link portion provided on the top of the substrate, and a length of the third link portion determines the lateral spacing between the third stub and the two ground planes, respectively.

The accompanying drawings are incorporated into the specification and form a part of the specification to illustrate several embodiments of the present invention. These drawings, together with the description, serve to explain the principles of the invention. The drawings are merely for the purpose of illustrating the preferred and alternative examples of how the invention can be made and used, and are not to be construed as limiting the invention to only the illustrated and described embodiments.

Furthermore, several aspects of the embodiments may form—individually or in different combinations—solutions according to the present invention. Further features and advantages will be become apparent from the following, more particular description of the various embodiments of the invention as illustrated in the accompanying drawings, in which like references refer to like elements, and wherein:

DETAILED DESCRIPTION

Figure 1:
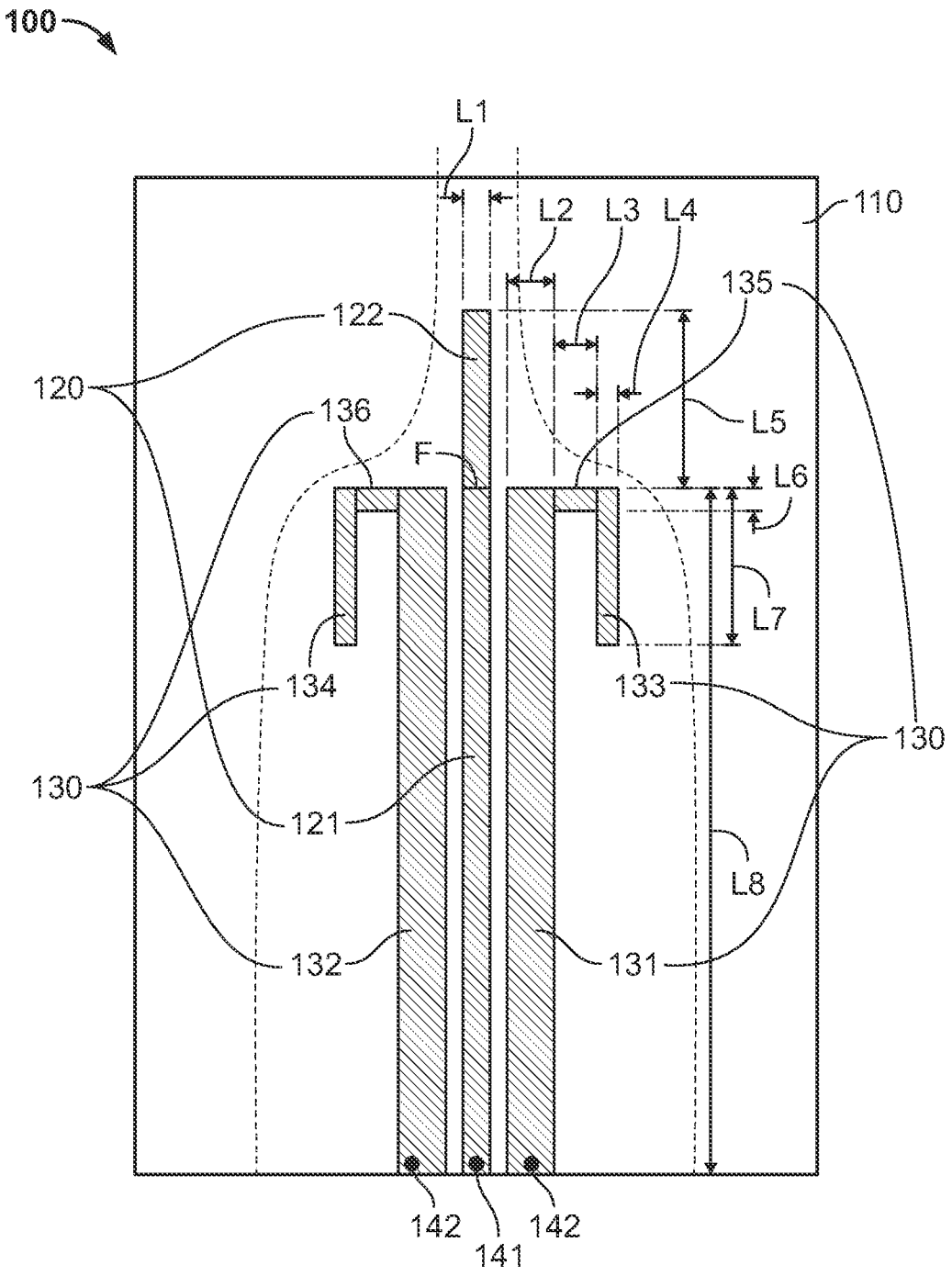
FIG. 1 shows a schematic view of the antenna element according to a first embodiment of the invention.

Referring to FIG. 1, the antenna element 100 according to a first embodiment of the invention is illustrated. FIG. 1 shows a schematic view of the antenna element 100.

The antenna element 100 comprises a substrate 110 as a structural element on which a first conductor 120 and a second conductor 130 are disposed. Inherent to the configuration of the antenna element 100, the substrate 110 is provided of dielectric material in order to prevent a short circuit between the first conductor 120 and the second conductor 130. In other words, the substrate 110 provides structural support and thereby separates the first conductor 120 from the second conductor 130 such that both conductors 120 and 130 have distinct shapes of conducting material.

According to an exemplary realization, the substrate may be provided of a material that provides, at the desired frequency, for low losses in terms of quality factor, or dissipation factor, for a particular permittivity or dielectric constant. For example, epoxy- or polyamid-based materials provide sufficient structural support for the first conductor 120 and the second conductor 130. Other exemplary materials to be used for the substrate could be FR4, PC (polycarbonate) or ABS (acrylonitrile butadiene styrene).

The antenna element 100 further comprises the first conductor 120. The first conductor 120 includes a feed line portion 121 and a monopole portion 122. The first conductor 120 is disposed on a first lateral surface, for instance the front face, of the substrate 110.

A distinction between the feed line portion 121 and the monopole portion 122 of the first conductor 120 is made in view of its functionality in combination with the second conductor 130, as will be explained in more detail below. The intersection between feed line portion 121 and monopole portion is called antenna feed point F.

The first conductor 120 further includes an RF input 141 for feeding an RF signal to be transmitted via the monopole portion 122 of the first conductor 120. In other words, the RF signal is input via RF input 141 at a proximal end of feed line portion 121 of the first conductor 120 to be radiated by the monopole portion 122 of the first conductor 120. The RF signal may be supplied via a coplanar transmission line or a coaxial cable to the RF input 141.

According to an exemplary implementation of the antenna element 100 configured for the desired frequency of 6 GHz, the feed line portion 121 of the first conductor 120 is rectangular and has the length L8 of 41 mm and has a width L1 of 1 mm; the monopole portion 122 of the first conductor 120 is also rectangular, has the length L5 of 11 mm and has the same width L1 of 1 mm; accordingly both the feed line portion 121 and the monopole portion 122 of the first conductor 120 have a same width.

The antenna element 100 further comprises a second conductor 130. The second conductor 130 includes two ground planes 131 and 132 and at least two stubs 133 and 134. The second conductor 130 is at least partially disposed on the first lateral surface of the substrate 110.

The two ground planes 131 and 132 are disposed on the first lateral surface adjacent to the feed line portion 121 of the first conductor 120 at opposite sides thereof. Accordingly, a first of the two ground planes 131 is disposed on a right side of the feed line portion 121 and a second of the two ground planes 132 is disposed on a left side of the feed line portion 121 of the first conductor 120. The terms "left side" and "right side" refer to a front-side-up orientation of the first conductor 120.

The second conductor 130 further includes a Ground connection 142 for supply of a GND signal to the two ground planes 131 and 132 of the second conductor 130. In other words, the GND signal is input via Ground connection 142 at a proximal end of either of ground planes 131 and 132 of the second conductor 130 to provide a reference voltage for the first conductor 120. The GND signal may be supplied via a coplanar transmission line or a coaxial cable to the GND connection 142.

Further to the exemplary implementation configured for the desired frequency of 6 GHz, the two ground planes 131 and 132 are both rectangular have a length L8 of 41 mm and have a width L2 of 3 mm, respectively.

According to an exemplary realization, the two ground planes 131 and 132 may be provided equidistantly at opposite sides of the feed line portion 121 of the first conductor 120. In other words, the distance between the feed line portion 121 of the first conductor 120 and the two ground plane 131 and 132 of the second conductor 130 is same on both opposite sides.

Further to the exemplary implementation configured for the desired frequency of 6 GHz, the distance between the feed line portion 121 of the first conductor 120 and the two ground plane 131 and 132 of the second conductor 130 on both opposite sides has the width of 0.5 mm.

The two stubs 133 and 134 are also part of the second conductor 130. Accordingly, it is implicit that the two stubs are electrically connected to the respective of the two ground planes 131 and 132 of the second conductor 130. According to an exemplary realization the two stubs 133 and 134 may be electrically connected via two link portions 135 and 136 to the two ground planes 131 and 132 of the second conductor 130, respectively.

Further, the two stubs 133 and 134 are disposed on the first lateral surface of the substrate 110 at opposite sides of the respective two ground planes 131 and 132. Accordingly, a first of the two stubs 133 is disposed on a right side of the first of the two ground planes 131 and a second of the two stubs 134 is disposed on a left side of the second of the two ground planes 132. The terms "left side" and "right side" refer to a front-side-up orientation of the second conductor 130.

In particular, with the two ground planes 131 and 132 being disposed at opposite sides of the feed line portion 121 of the first conductor 120 and with the two stubs 133 and 134 being disposed at opposite sides of the respective of the two ground planes 131 and 132, it becomes clear that the two stubs 133 and 134 are disposed at opposite sides of the feed line portion 121 of the first conductor 120.

In other words, the two stubs 133 and 134 of the second conductor 130 are disposed at a position towards the proximal end of the antenna element 100 and do not reach into areas next to (i.e. adjacent to) the monopole portion 122 of the first conductor 120. Accordingly, the configuration of the antenna element 100 preserves an open space at opposite sides of the monopole portion 122 of the first conductor 120.

The two stubs 133 and 134 of the second conductor 130 extend in a direction that is essentially parallel to the feed line portion 121 of the first conductor 120. With the monopole portion 122 being in line with the feed line portion 121 of the first conductor, two stubs 133 and 134 also extend in a direction that is essentially parallel to the monopole portion 122.

Further to the exemplary implementation configured for the desired frequency of 6 GHz, the two stubs 133 and 134 of the second conductor 130 are both rectangular, have a length L7 of 8 mm and have a width L4 of 1 mm.

According to an exemplary realization, the two stubs 133 and 134 may be respectively coupled to the two ground planes 131 and 132 at a predetermined distance from a free end of the first conductor 120. The predetermined distance corresponds to the length of the monopole portion 121 of the first conductor 120.

The free end of the first conductor 120 corresponds to the distal end of the antenna element 100 and equally corresponds to the top end (i.e. apex) of the monopole portion 122. In other words, in the exemplary realization the two stubs 133 and 134 can be respectively coupled to the two ground planes 131 and 132 near the antenna feed point F, namely near the intersection between the feed line portion 121 and the monopole portion 122.

According to a further exemplary realization, the two stubs 133 and 134 may be electrically connected to the two ground planes 131 and 132 via two link portions 135 and 136, respectively. In more detail, one of the two link portions 135 electrically connects the first of the two stubs 133 to the first of the two ground planes 131, and another of the two link portions 135 electrically connects the second of the two stubs 134 to the second of the two ground planes 132.

In another exemplary realization, the width L3 of the two link portions 135 and 136 can determine the lateral spacing between the two stubs 133 and 134 and the two ground planes 131 and 132, respectively. In other words, the width L3 of the first of the two link portions 135 determines the lateral spacing between the first of the two stubs 133 and the first of the two ground planes 131, and the width L3 of the second of the two link portions 136 determines the lateral spacing between the second of the two stubs 134 and the first of the two ground planes 132.

Further to the exemplary implementation configured for the desired frequency of 6 GHz, the two link portions 135 and 136 of the second conductor 130 are both rectangular and have a length L6 of 1 mm and a width L3 of 4 mm.

The two ground planes 131 and 132 and the two stubs 133 and 134 of the second conductor 130 together form a coplanar waveguide as will become apparent from the description below.

In the context of the description, the term "coplanar" or "planar" shall not limit the invention to a flat surface (i.e. plane) but shall be construed in the sense as to relate to any surfaces, particularly including curved surfaces. In this respect, the expression "ground planes and stubs together form a coplanar waveguide" refers to the fact that both are co-located on the same (e.g. curved) surface and thereby form a waveguide.

According to yet another exemplary realization, the first lateral surface of the substrate 110 on which the first conductor 120, the two ground planes 131 and 132 and the two stubs 133 and 134 of the second conductor 130 are disposed, may be laterally curved. The term "laterally curved" has to be construed in view of the longitudinal extension of the antenna element 100, for instance of the first conductor 120. For example, the curvature can have a radius R1 in the range of 10 mm to 50 mm.

Now, it is referred to the operation of the antenna element 100 of the first embodiment. In the following, the transmission operation of an RF signal by the antenna element 100 is described in more detail. However, the operation of the antenna element 100 is not limited thereto. In particular, the antenna element 100 may similarly be used for reception operation, i.e. where the antenna element is excited by an externally radiated signal.

An RF signal is input to the RF input 141 of the first conductor 120 and a GND signal is input to the ground connection 142 of the second conductor 130. Due to the ground planes 131 and 132 of the second connector 130, the feed line portion 121 of the first conductor 120 operates as a coplanar transmission line to carry the RF signal received at the RF input 141 to the antenna feed point F.

A voltage at the gap between the feed line portion 121 of the first conductor 120 and the two ground planes 131 and 132 of the second conductor 130 at antenna feed point F, as created by the RF signal, causes an RF current to flow on the monopole portion 122 of the first conductor 120. The differential current carried by feed line portion 121 of the first conductor 120 returns to the RF input 141 along the surface of the ground plane portion 131 and 132 of the second conductor 130 that is closest to the feed line portion 121.

The energy radiated by the monopole portion 122 of the first conductor 120 may also induce a common mode current that flows away from antenna feed point F along the surface of the two ground planes 131 and 132 of the conductor that is closest to the feed line portion 121. Problems may arise such as unwanted RF radiation from the two ground planes 131 and 132 due to their limited width and length.

Generally, it is well understood that if the common mode current is permitted to flow along the two ground planes 131 and 132, problems may arise such as unwanted RF radiation from the two ground planes 131 and 132 due to their limited width and length.

In order to eliminate or to reduce unwanted RF radiation from the two ground planes 131 and 132, the two stubs 133 and 134 are employed. The common mode current may tend to flow around to the other side of the two stubs 133 and 134 (i.e. to the surface of the stubs that is farthest from feed line portion 131) and returns to the distal ends of the two stubs 133 and 134.

In designing an antenna element, the lengths of the two stubs 133 and 134 may be selected to impede a flow of common mode current back to the RF input 141. This impedance effect may be explained by considering that the two ground planes 131 and 132 and the two stubs 133 and 134 form a coplanar waveguide (CPW) transmission line. According to this model, the two ground planes 131 and 132 form the center conductor of the CPW, and the two stubs 133 and 134 form the outer conductors of the CPW. The waveguide is short-circuited at its distal end by link portions 135 and 136.

If the effective length of the CPW is approximately one quarter-wavelength (e.g. at the center frequency of the desired frequency band), then the impedance at the open end of the CPW (e.g. at the proximal ends of the two stubs 133 and 134) may be nearly infinite at the operating frequency.

This impedance resists the flow of common mode current back to the source along the two ground planes 131 and 132, resulting in a tendency for the antenna to be more balanced in the sense that radiation by the feed line is reduced or eliminated. In such a case, it may be desirable for monopole portion 122 of the first conductor 120 to have an effective length of approximately one-quarter wavelength as well. However, the effective lengths of the monopole and feed line portions may be multiples of one-quarter of the wavelength of the desired frequency.

It is understood that any description of the operation of an antenna element according to an embodiment is presented herein for explanatory purposes only. Notably, such explanation does not itself represent or impose any limitation on any configuration as set forth in the various realizations described above.

In summary, the antenna element 100 has dimensions and shape to geometrically fit into a roof-top antenna assembly. Exemplarily, a roof-top antenna assembly may have the dimensions illustrated as dashed lines in FIG. 1.

In more detail, the construction of the antenna element 100 allows for a narrow proximal end of the substrate 110. The areas at both sides of the monopole portion 122 of the antenna element 100 are left empty such that no portion of the second conductor 130 (i.e. stubs 133 and 134) is disposed at close proximity to the monopole portion 122. At the same time, stubs 133 and 134 can be realized with a same length as monopole portion 122, namely, $\lambda/4$. Accordingly, the antenna element 100 may advantageously be incorporated into a roof-top antenna assembly.

Additionally, the antenna element 100 equally realizes the advantage of an omni-directional radiation pattern. Specifically, the construction of the antenna element 100 including the monopole portion 122 sticking out from the second conductor 130 provides for an improved capability to radiate equal power in all directions perpendicular to the extent of the antenna element 100.

Figure 2A:
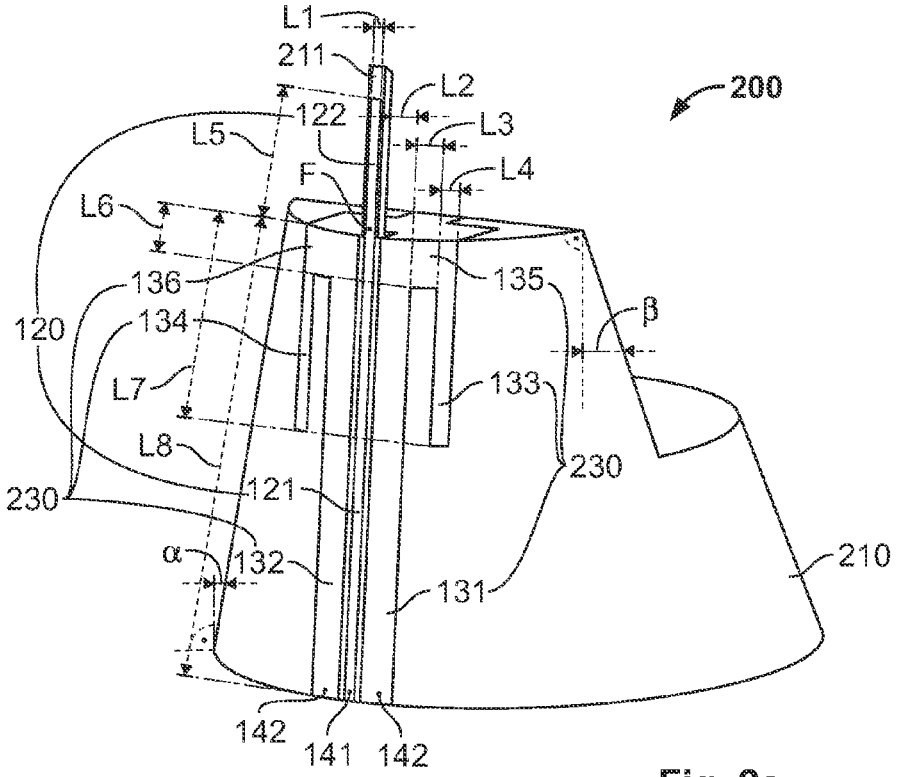
FIGS. 2*a* and 2*b* show different schematic views of the antenna element according to a second embodiment of the invention.
Figure 2B:
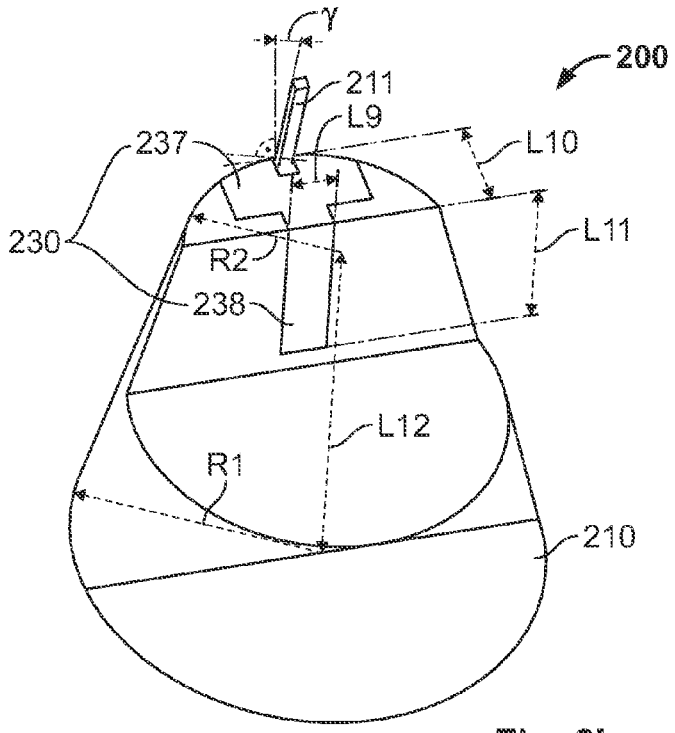

Referring now to FIGS. 2*a* and 2*b* an antenna element 200 according to the second embodiment of the invention is shown. Specifically, FIG. 2*a* schematically shows the antenna element 200 in a frontal view whereas FIG. 2*b* schematically illustrates the antenna element 200 in a rearward view.

The antenna element 200 is based on the antenna element 100 of FIG. 1 where corresponding parts are given corresponding reference numerals and terms. The description of corresponding parts has been omitted for reasons of conciseness. The antenna element 200 of FIGS. 2*a* and 2*b* differs from the antenna element 100 in that it has a three-dimensional and not a planar shape.

The antenna element 200 comprises a three-dimensional substrate 210 as structural element on which the first conductor 120 and a second conductor 230 are disposed. Inherent to the configuration of the antenna element 100, the substrate 110 is provided of dielectric material in order to prevent a short circuit between the first conductor 120 and the second conductor 230.

Specifically, the substrate 210 of the antenna element 200 is shaped as a frustum of a cone with the first conductor 120 and the second conductor 230 disposed on at least one lateral surface thereof. The shape of a frustum of a cone is, however, only one exemplary realization of the substrate 210; the substrate 210 may alternatively be shaped as a frustum of a pyramid, a cylinder, a cuboid or a cube.

In case of a frustum-shaped substrate 210, the first lateral surface of the substrate 210 is laterally curved. The term "laterally curved" has to be construed in view of the longitudinal axis of the antenna element 200, for instance of the first conductor 120. For example, the curvature R1 can have a radius in the range of 50 mm to 150 mm.

Further, for a frustum-shaped substrate 210, the first lateral surface, on which the first conductor 220 and the second conductor 230 are at least partially disposed, is tilted with respect to the base of the base of the substrate 200. For example, the first lateral surface may have an angle ($90°-\alpha$) in the range of 60 to 85 degrees with respect to the base of the substrate 210 such that the tilt has an angle $\alpha$ in the range of 5 to 30 degrees.

The first conductor 120 includes the feed line portion 121 and the monopole portion 122 as already explained with respect to the first embodiment. The first conductor 120 is disposed on the first lateral surface, for instance the front face, such that the first conductor 120 extends along the longitudinal axis of the substrate 210 shaped as a frustum of a cone. Accordingly, with the first lateral surface being tilted with respect to the base of the substrate 210, also the first conductor 120 is arrange in a tilted configuration with respect to the base of the substrate 210.

The monopole portion 122 of the first conductor 120 of the antenna element 200 is provided on a portion of the substrate 210 protruding from a top of the substrate 210. In particular, the substrate 210 additionally includes a support member 211 which protrudes from the rim of the top of the substrate to support the monopole portion 122 of the first conductor. The support member 211 is provided on the top of the substrate 210 such that it has an angle $\gamma$ with respect to the top of the substrate 210 as shown, for instance, in FIG. 2*b*.

Accordingly, the feed line portion 121 of the first conductor 120 is provided on the first lateral surface of the substrate 210 to span the entire surface between the base and the top thereof. Accordingly, the length of the feed line portion 121 of the first conductor 120 corresponds to the height of the lateral surface of the substrate 210. The term "height" refers to the longitudinal extent of the frustum-shaped substrate 210.

In one exemplary realization, the support member 212 is aligned with the substrate 210, such that it extends along the lateral surface of the substrate 210 in a longitudinal direction. In this case, the angle $\gamma$ of the support member 212 with respect to the top of the substrate 210 corresponds to the angle $\alpha$ of the substrate's lateral surface with respect to the base of the substrate 210.

In a different exemplary realization, the support member 211 may be tilted with respect to the top of the substrate 210 such that the angle $\gamma$ of the support member 211 with respect to the top of the substrate 210 is different from the angle $\alpha$ of the substrate's lateral surface with respect to the base of the substrate 210. In this case, the support member 212 may be provided with an angle $\gamma$ to the top of the substrate that compensates for the tilt at angle $\alpha$ of the lateral surface with respect to the base of the substrate 210, for instance such that $\gamma=-\alpha$.

The antenna element 200 further comprises a second conductor 230. The second conductor 230 includes two ground planes 131 and 132 and three stubs 133, 134 and 238. The second conductor 230 is at least partially disposed on the first lateral surface of the substrate 210.

The two ground planes 131 and 132 of the second conductor 230 are disposed on the first lateral surface adjacent to the feed line portion 121 of the first conductor 120 at opposite sides thereof. Further, the two stubs 133 and 134 are disposed on the first lateral surface of the substrate 210 at opposite sides of the respective two ground planes 131 and 132.

Notably, in the antenna element 200 the substrate 210 further includes a second lateral surface opposing the first lateral surface, and the second conductor 230 further includes a third stub 238 which is disposed on the second lateral surface at a position opposite to the feed line portion 121 of the first conductor 120 on the first lateral surface.

For example, the second lateral surface of the substrate 210 may be tilted with respect to a base (or with respect to the top) of the substrate 210 at an angle $\beta$ in the range of 5 to 30 degrees.

For the antenna element 200, the two stubs 133 and 134 on the first lateral surface and the third stub 238 on the second lateral surface together surround the feed line portion 121 of the first conductor 120 with respect to a cross section that is essentially perpendicular to the longitudinal direction of the antenna element 200. The term "longitudinal direction" has to be understood as corresponding to (aside from angle $\alpha$) the direction in which the feed line portion 121 of the first conductor 120 extends.

Specifically, the third stub 238 is coupled to the two ground planes 131 and 132 at a predetermined distance from the free end of the first conductor 120, the predetermined distance corresponding to the length L5 of the monopole portion 122 of the first conductor 120.

More specifically, the third stub 238 is electrically connected to the two ground planes 131 and 132 via a third link portion 237 provided on top of the substrate 210, and a length L9 of the third link portion 237 determines the lateral spacing between the third stub 238 and the two ground planes 131 and 132, respectively.

According to an exemplary implementation of the antenna element 200 configured for the desired frequency of 6 GHz, the feed line portion 121 of the first conductor 120 is rectangular, has the length L8 of 41 mm and has a width L1 of 1 mm; the monopole portion 122 of the first conductor 120 is also rectangular, has the length L5 of 11 mm and has the same width L1 of 1 mm; the two ground planes 131 and 132 are both rectangular, have a length L8 of 41 mm and have a width of L2 of 3 mm, respectively; the distance between the feed line portion 121 and the two ground plane 131 and 132 on both opposite sides has the width of 0.5 mm.

Further to the exemplary implementation configured for the desired frequency of 6 GHz, the two stubs 133 and 134 of the second conductor 230 are both rectangular, have a length L7 of 8 mm and have a width L4 of 1 mm. The third stub 238 of the second conductor 230 is also rectangular, has a length L11 of 8 mm and has a width L9 of 3 mm. The two link portions 135 and 136 of the second conductor 130 are both rectangular and have a length L6 of 1 mm and a width L3 of 4 mm. The third link portion 237 of the second conductor 230 is polygonal, has a length L10 of 5 mm and a width in the range of 2 to 18 mm.

For various implementations, it has proven advantageous to select the dimensions of the antenna element 200 in accordance with the values specified in the following Table 1. The values have been expressed as functionally dependent on the wavelength $\lambda$ of the desired frequency. For example, at a desired frequency of 6 GHz, the wavelength corresponds to: $\lambda$=50 mm.

TABLE 1

| | |
|---|---|
| First conductor 120 | 0.3 mm ≤ L1 ≤ λ/10 |
| | λ/4 ≤ L5 ≤ 3/8λ |
| | λ/4 ≤ L8 |
| Second conductor 230 | L1 ≤ L2 ≤ λ/8 |
| | λ/20 ≤ L3 ≤ λ/8 |
| | 1.0 mm ≤ L4 ≤ λ/8 |
| | L6 ≤ λ/4 |
| | L7 = λ/4 |
| | L8 ≈ λ/4 |
| | L9 < λ |
| | L10 < λ/4 |
| | L11 ≈ λ/4 |
| Substrate 210 | λ/4 ≤ L12 |
| | R1 ≥ λ/4 |
| | R2 ≥ λ/4 |
| | α can be arbitrary |
| | β < 30° |
| | γ < 30° |

In summary, the antenna element 200 has dimensions and a shape to geometrically fit into a roof-top antenna assembly. Specifically, the construction of the antenna element 200 allows for a narrow proximal end of the substrate 210.

For this purpose, the substrate 210 is shaped, for instance as a frustum of a cone, with only a thin support member 211 sticking out from the top of the support member 210 for structurally supporting the monopole portion 122. Accordingly, the areas at all sides of the monopole portion 122 of the antenna element 200 are left empty. Nevertheless, stubs 133, 134 and 238 can still be realized with a same length as monopole portion 122, for instance, $\lambda/4$. Accordingly, the antenna element may advantageously be incorporated into a roof-top antenna assembly.

Additionally, the antenna element 200 equally realizes the advantage of an omni-directional radiation pattern. Specifically, the construction of the antenna element 200 including the monopole portion 122 sticking out from the second conductor 230 provides for an improved capability to radiate equal power in all directions perpendicular to the extent of the antenna element 200.

Figure 3B:
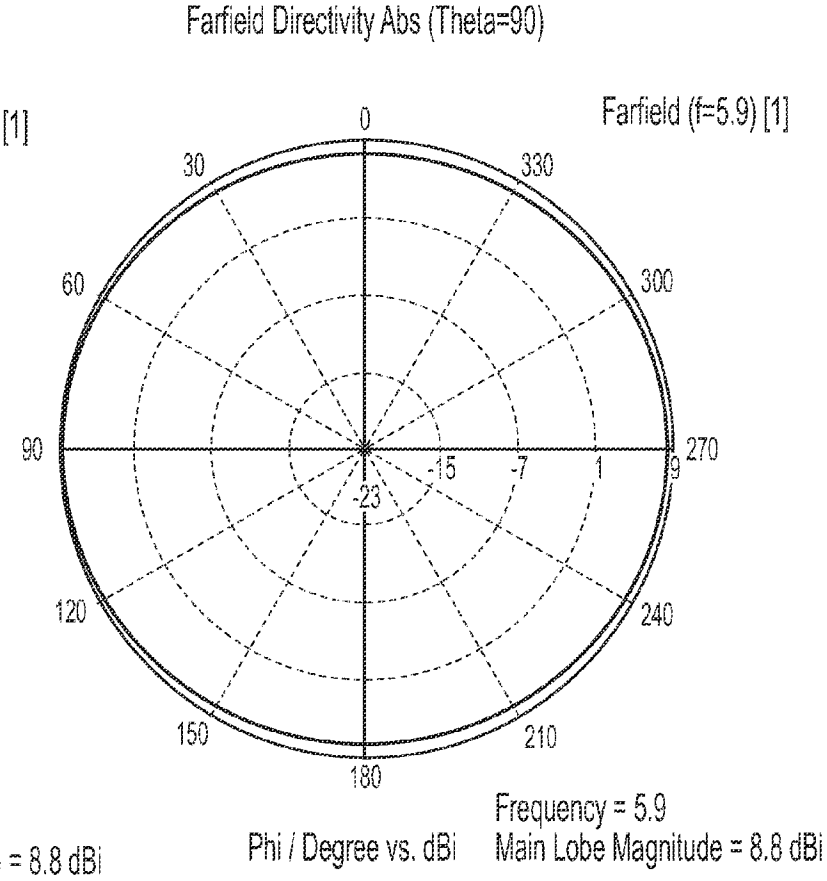
FIGS. 3*a* and 3*b* show simulation results of the antenna element according to the first embodiment of the invention.
Figure 3A:
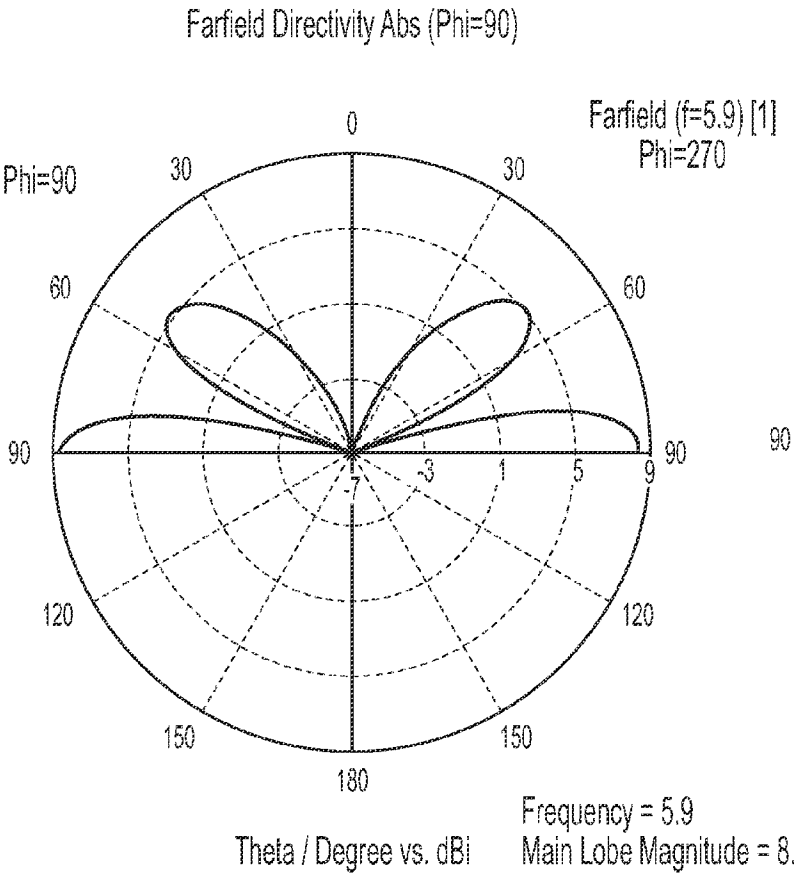

Referring now to FIGS. 3*a* and 3*b*, simulation results of the antenna pattern of the antenna element 100 according to the first embodiment of the invention are shown. The antenna element 100 is placed vertically on an infinite ground plane. FIG. 3*a* illustrates the antenna gain on a vertical plane; FIG. 3*b* illustrates the antenna gain on the horizontal plane.

FIG. 3*b* reveals that the antenna gain of the antenna element 100 in the horizontal plane resembles an azimuth pattern yielding an omni-directional pattern at horizon with a variation of less than 2 dB. The main lobe magnitude of 8.8 dBi at a direction of 90 degree in the x-y plane (Theta=90 degrees).

Further, FIG. 3*a* indicates that the antenna gain of the antenna element 100 in the vertical plane has a main lobe magnitude of 8.8 dBi at a main lobe direction of 90 degrees in the x-z plane (Phi=90 degrees). The main lobe has an angular width (measured at 3 dB) of 9.3 degrees. Further, the side lobe level is 5.2 dB at approximately a side lobe direction of 50 degrees in the y-z plane.

In summary, the antenna elements of the various embodiments advantageously have an omni-directional radiation pattern in the horizontal plane. This allows the antenna element to be used in the field of car-to-car communication where it is important that wireless communication can be engaged in any horizontal direction.

Additionally, the antenna elements of the various embodiments allow for production by way of 3d surface metallization technologies such as Molded Interconnect Device technology (MID) in combination with Laser Direct Structuring (LDS) or 3D printing.

REFERENCES

| Reference Numerals | Description |
|---|---|
| 100, 200 | Antenna element |
| 110, 210 | Substrate |
| 120 | First conductor |
| 121 | Feed line portion |
| 122 | Monopole portion |
| F | Feed point |
| 130 | Second conductor |
| 131, 132 | Ground planes |
| 133, 134 | Stubs |
| 135, 136 | Link portion(s) |
| 141 | RF input |
| 142 | Ground connection |
| 211 | Support member |
| 237 | Link portion |
| 238 | Third stub |

The invention claimed is:

1. Antenna element comprising:

a substrate having at least a first lateral surface, a first conductor provided on the first lateral surface, said first conductor including a feed line portion and a monopole portion;

a second conductor provided at least partially on the same, first lateral surface, wherein, said second conductor includes:

two ground planes which are disposed on the first lateral surface adjacent to the feed line portion of the first conductor at opposite sides thereof, and two stubs which are disposed on the first lateral surface at opposite sides of the respective of the two ground planes, and which extend in a direction essentially parallel to the feed line portion of the first conductor; and wherein each of the two stubs is electrically connected to the respective of the two ground planes, and the two ground planes and the two stubs of the second conductor are arranged to form a coplanar waveguide; and wherein the first lateral surface is laterally curved, the curvature having a radius (R1) in the range of $\lambda$ to $\lambda/4$, wherein $\lambda$ corresponds to the wavelength of the preferred frequency of the antenna element.

2. The antenna element according to claim 1, wherein the substrate is shaped as a frustum of a cone with the first and second conductor disposed on at least one lateral surface thereof.

3. The antenna element according to claim 1, wherein the first lateral surface is tilted with respect to a base of the substrate at an angle ($\alpha$) in the range of 5 to 30 degrees.

4. The antenna element according to claim 1, wherein the monopole portion of the first conductor is provided on a portion of the substrate protruding from a top of the substrate.

5. The antenna element according to claim 1, wherein the two stubs are respectively coupled to the two ground planes at a predetermined distance from the free end of the first conductor, the predetermined distance corresponding to the length of the monopole portion of the first conductor.

6. The antenna element according to claim 1, wherein the two stubs are electrically connected to the two ground planes via two link portions, respectively, and a length (L3) of the two link portions determines the lateral spacing between the two stubs and the two ground planes, respectively.

7. The antenna element according to claim 1, wherein the monopole portion of the first conductor is tilted with respect to the feed line portion of the first conductor at an angle in the range of 5 to 30 degrees.

8. The antenna element according to claim 1, wherein the length of the monopole portion is approximately $\lambda/4$ and the length of the two stubs is approximately $\lambda/4$, wherein $\lambda$ corresponds to the wavelength of the preferred frequency of the antenna element.

9. The antenna element according to claim 1, wherein:

the substrate further includes a second lateral surface opposing the first lateral surface, and the second conductor further includes a third stub which is electrically connected to the two ground planes and is disposed on the second lateral surface at a position opposite to the feed line portion on the first lateral surface.

10. The antenna element according to claim 9, wherein the two stubs on the first lateral surface and the third stub on the second lateral surface together surround the feed line portion of the first conductor with respect to a cross section that is essentially perpendicular to a direction in which the feed line portion extends.

11. The antenna element according to claim 9, wherein the second lateral surface is tilted with respect to a base of the substrate at an angle in the range of 5 to 30 degrees.

12. The antenna element according to claim 9, wherein the length of the third stub is approximately $\lambda/4$, wherein $\lambda$ corresponds to the wavelength of the preferred frequency of the antenna element.

13. The antenna element according to claim 9, wherein the third stub is coupled to the two ground planes at a predetermined distance from the free end of the first conductor, the predetermined distance corresponding to the length of the monopole portion of the first conductor.

14. The antenna element according to claim 9, wherein the third stub is electrically connected to the two ground planes via a third link portion provided on a top of the substrate, and a length (L3) of the third link portion determines the lateral spacing between the third stub and the two ground planes, respectively.

* * * * *